United States Patent [19]

Sasagawa

[11] Patent Number: 4,961,396

[45] Date of Patent: Oct. 9, 1990

[54] TRIM ADJUSTING DEVICE FOR JET PROPULSION BOAT

[75] Inventor: Souichi Sasagawa, Iwata, Japan

[73] Assignee: Yamaha Hatsudoki Kabushiki Kaishi, Iwata, Japan

[21] Appl. No.: 318,678

[22] Filed: Mar. 3, 1989

[30] Foreign Application Priority Data

Mar. 4, 1988 [JP] Japan ..... 63-51848

[51] Int. Cl.[5] ..... B63B 1/18

[52] U.S. Cl. ..... 114/285

[58] Field of Search ..... 114/271, 284–287, 114/270; 441/74; 440/38

[56] References Cited

U.S. PATENT DOCUMENTS 2,779,302 1/1957 Atkinson ..... 114/285
3,002,485 10/1961 Curtis ..... 114/285
3,371,642 3/1968 Joy ..... 114/285
3,520,265 7/1970 Sanford ..... 114/285
3,783,817 1/1974 Banner ..... 114/285

*Primary Examiner*—Joseph F. Peters, Jr.
*Assistant Examiner*—Edwin L. Swinehart
*Attorney, Agent, or Firm*—Ernest A. Beutler

[57] ABSTRACT

A jet propulsion boat having an improved arrangement for rigidly affixing a trim adjusting plate to the underside rear portion of the boat hull and which permits adjustment of the trim angle of the plate. In one embodiment, an angle adjusting means is threadably connected to the trim adjusting plate and passes a threaded fastener that affixes the angle adjusting means and the trim adjusting plate to the hull. In another embodiment, a shim member is interposed between the trim adjusting plate and the hull for effecting trim adjustment of the trim adjusting plate.

10 Claims, 4 Drawing Sheets

TRIM ADJUSTING DEVICE FOR JET PROPULSION BOAT

BACKGROUND OF THE INVENTION

This invention relates to a trim adjusting device for a jet propulsion boat and more particularly to an improved, simplified and high strength trim adjusting device for such applications.

A very popular type of small watercraft is the jet propelled type of boat that is designed to be operated by a single rider and which is powered by a jet propulsion unit. This type of watercraft, because of its small nature, is sensitive to the differences in weight of the individual operators and riders. In order to provide optimum operation, it has been proposed to provide a trim adjustment for the watercraft that is comprised of a trim adjusting plate that is pivotally supported at its forward end on the rear portion of the underside of the watercraft hull. The angular adjustment of the plate can be changed to suit the requirements of the rider so as to adjust the trim angle. Although this type of device has advantages, the use of the hinge connection presents certain problems.

For example, the use of the hinged connection introduces components into the system which can wear and become damaged. As the hinge joint wears, the trim plate will become loosened and causes a reduction in the accuracy of the trim adjustment and also fluctuation of the trim adjustment during running. Furthermore, this type of device only permits fore and aft trim adjustment and not side to side trim adjustment.

It is, therefore, a principal object of this invention to provide an improved trim adjusting device for a small watercraft such as a jet propulsion boat.

It is a further object of this invention to provide an improved trim adjusting device for a watercraft that provides a wide variety of trim adjustments and yet provides a rigid assembly that will not wear and will give security to the rider.

It is a further object of this invention to provide an improved positive and low cost trim adjusting device for a small watercraft.

SUMMARY OF THE INVENTION

This invention is adapted to be embodied in a trim adjusting device for the underside of a jet propulsion boat hull that is comprised of a trim adjusting plate that is adapted to underlie the rear underside edge of the boat hull. Threaded fastening means are provided for rigidly affixing the trim adjusting plate to the hull and angle adjusting means are interposed between the hull and the trim adjusting plate for setting the trim angle of the trim adjusting plate relative to the hull.

DETAILED DESCRIPTION OF THE PREFERRED EMBODIMENTS OF THE INVENTION

Figure 1:
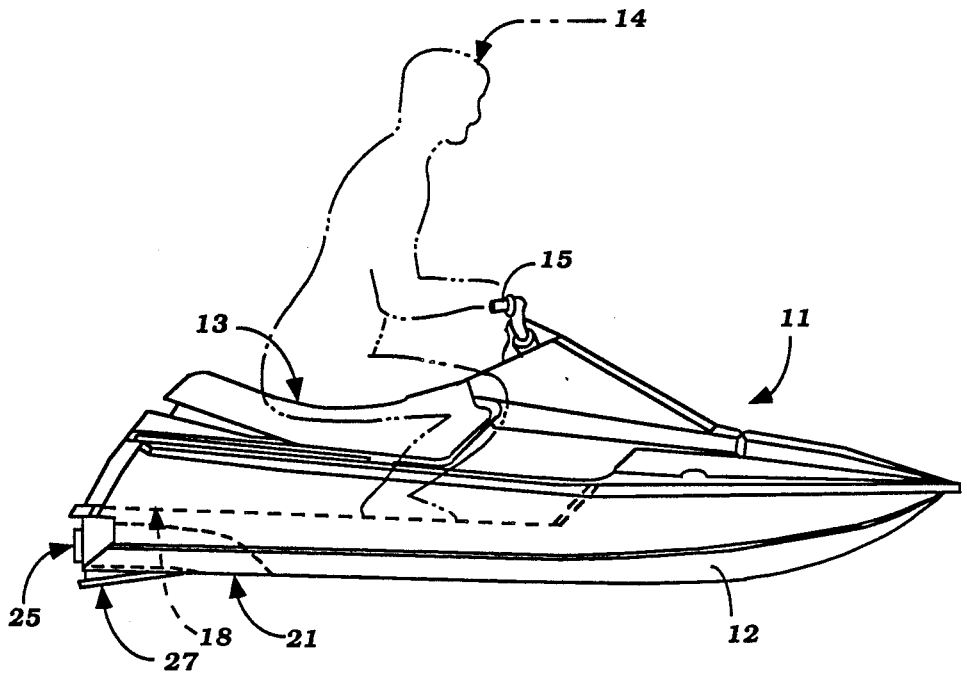
FIG. 1 is a side elevational view of a small watercraft constructed in accordance with an embodiment of the invention.

Referring first primarily to FIG. 1, a small watercraft constructed in accordance with an embodiment of the invention is identified generally by the reference numeral 11. The watercraft 11 is comprised of a hull 12 which has any suitable configuration. The hull 12 is provided with a rider's area that is comprised of a seat 13 onto which a rider, shown in phantom and identified by the reference numeral 14 may be seated in straddle fashion. A handlebar assembly 15 is positioned forwardly of the seat so as to permit steering of the watercraft in a manner to be described.

Figure 2:
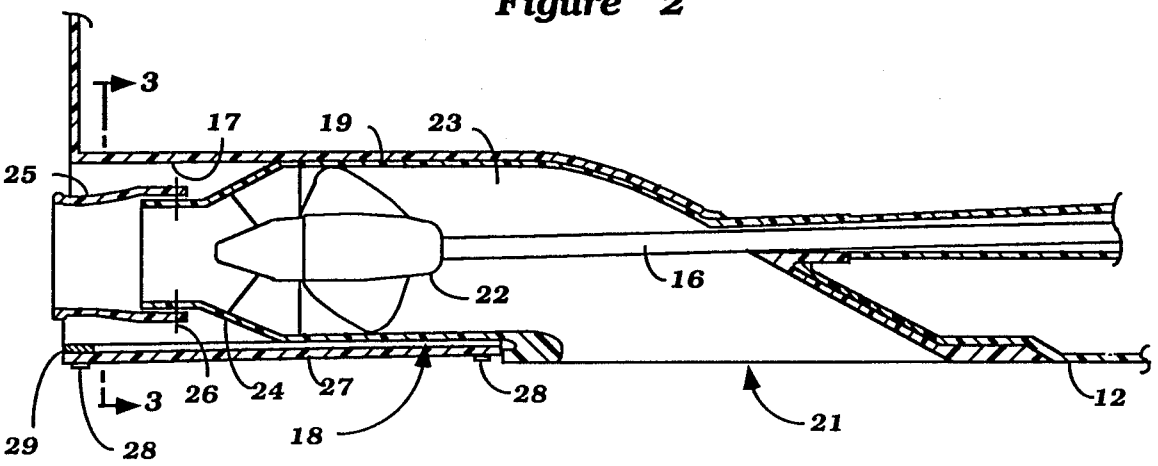
FIG. 2 is an enlarged cross-sectional view taken through the longitudinal center line of the hull at the rear end thereof and shows the jet propulsion unit and the trim adjusting plate.
Figure 3:
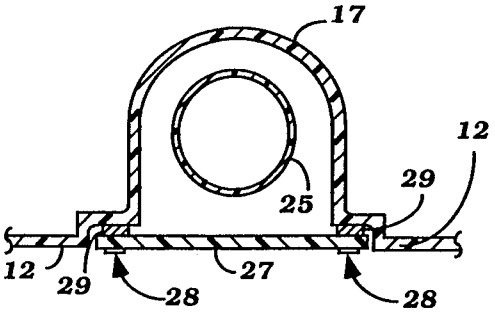
FIG. 3 is a cross-sectional view taken along the line 3—3 of FIG. 2.
Figure 4:
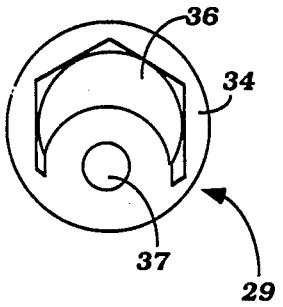
FIG. 4 is an enlarged bottom plan view of a portion of the trim adjusting mechanism.

Referring now additionally to FIGS. 2 and 3, the hull 12 is provided with an engine compartment that is disposed generally forwardly of and beneath the handlebar assembly and in which a suitable powering internal combustion engine (not shown) may provided. This engine drives a propeller shaft 16 that extends rearwardly within the hull 12 and enters into a tunnel area 17 that is formed rearwardly of the underside of the hull 12 at the center thereof. Contained within the tunnel 17 is a jet propulsion unit, indicated generally by the reference numeral 18 and which includes an outer duct 19 that forms a downwardly facing water inlet opening 21. An impeller 22 is supported within the a duct 23 and pressurizes water that is drawn into the inlet opening 21 and forces it though a diverging nozzle section 24. A pivotally supported steering nozzle 25 is supported at the rear end of the portion 24 for steering movement about a vertically extending axis 26. The steering nozzle 25 is steered by the handlebar assembly 15 for changing the direction of movement of the watercraft as is well known in this art.

The construction of the watercraft 11 as thus far described may be considered to be conventional and as to those conventional components, a more detailed description is not believed to be necessary so as to understand the construction and operation of the invention. However, in accordance with the invention, there is provided a trim adjusting plate indicated generally by the reference numeral 27 that is affixed to and underlies the lower portion of the tunnel 17 beneath the jet propulsion unit 18. The trim adjusting plate is affixed to the hull 12 and specifically the underside rear portion thereof by means of a mounting assembly now to be described and which mounting assembly permits adjustment of the trim angle of the plate 27 both in fore and aft and in side to side directions.

Basically, the trim adjusting plate 27 is rigidly affixed to the hull 12 by means of four mounting bolts 28. The mounting bolts 28 may each be associated with a respective angle adjusting device, indicated generally by the reference numeral 29. Alternatively, adjusting devices 29 may be provided at only opposite sides of the rear edge of the trim adjusting plate 27. In the embodiment shown in FIGS. 1 through 4, such an arrangement is provided. It should be understood, however, that such mounting arrangements can be provided at all four corners of the trim adjusting plate 27.

Figure 5:
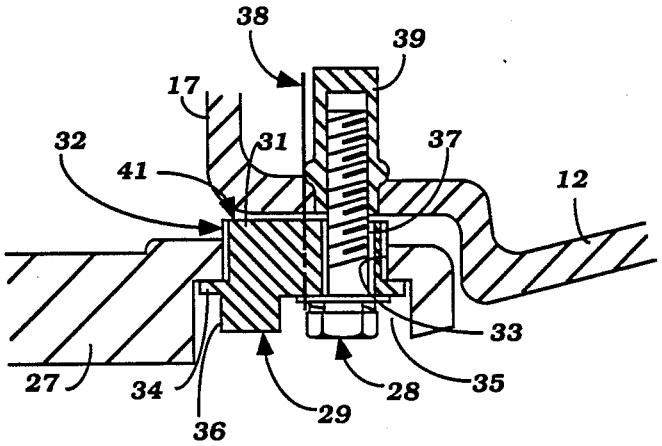
FIG. 5 is an enlarged cross-sectional view taken along a plane similar to the plane of FIG. 3 but on a much larger scale and shows the trim adjusting mechanism in the maximum trim angle position.
Figure 6:
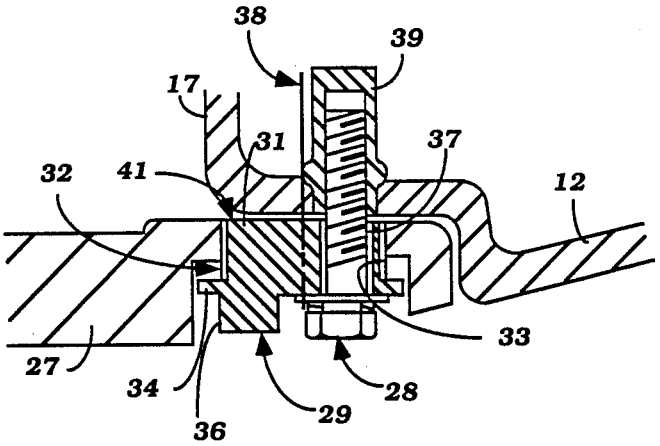
FIG. 6 is a cross-sectional view, in part similar to FIG. 5, showing the device in the minimum trim angle position.

The angle adjusting means 29 is comprised of a generally cylindrical portion 31 that is formed with an externally threaded surface 32 that is threadably received within a corresponding threaded opening 33 formed at the respective corner of the trim adjusting plate 27. A cylindrical flange 34 encircles the lower portion of the threaded part 32. It should be noted that this threaded adjustment permits the angle adjusting means to be moved from a position as shown in FIG. 5 wherein the flange 36 engages the underside of the trim adjusting plate 27 to a position as shown in FIG. 6 wherein there is a considerable difference between the flange 34 and the plate 27. It should also be noted that the trim adjusting plate 27 is provided with a recessed area 35 in which the angle adjusting device 29 and bolt 28 are received so that these components will be protected and will not be damaged if the underside of the watercraft strikes any submerged object.

The rotation of the angle adjusting means is achieved by means of a partially hexagonal section 36 that forms a head which can conveniently engaged by a suitable tool or wrench for rotating the angle adjusting device 29 relative to the plate 27 so as to screw the threaded connection 32, 33, in or out.

Eccentric to the threaded portion 32 and in the area where the hexagonal portion 36 is interrupted, there is provided a through bore 37. This bore 37 is offset from the center line, indicated by the broken line 38 as aforenoted. The bore 37 is sized so as to pass the threaded shank of the bolt 28 which is then threaded into a receiver 39 fixed suitably to the hull 12.

It should be noted that the angle adjusting device 29 has an upper face 41 that is adapted to be abuttingly engaged with the underside of the hull 12 so as to provide firm and rigid abutment between the adjusting device 29 and the hull 12. The bolt 28 holds the assembly in this adjusted position and thus offers a positive adjustment and one which cannot work loose. Because the bolt 28 is offset relative to the angle adjusting device 29, further locking devices for the angle adjusting device 29 are not required and the device is, in effect, self locking.

Figure 7:
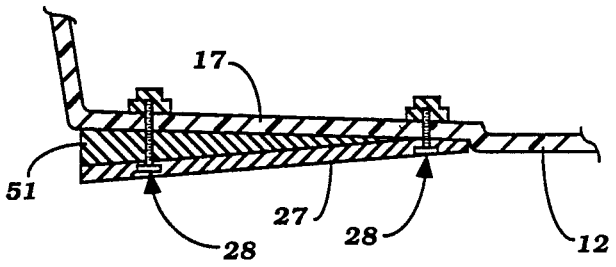
FIG. 7 is a cross-sectional view, in part similar to FIG. 2, showing another form of trim adjusting mechanism.

FIG. 7 shows another embodiment of the invention wherein rigid bolts 28 are also employed so as to hold the trim adjusting plate 27 in position. In this embodiment, however, variable angle spacers 51 are interposed between the trim adjusting plate 27 and the hull 12 so as to provided the rigid trim adjustment.

It should be readily apparent from the foregoing description that two embodiments of the invention have been illustrated and described, each of which provides an effective and rigid trim adjustment for the plate which can be adjusted both fore and aft and angularly and which will not work loose nor be subject to wear.

Although two embodiments of the invention have been illustrated and described along with modifications of those embodiments, various changes and modifications may be made without departing from the spirit and scope of the invention, as defined by the appended claims.

I claim:

1. A trim adjusting device for the underside of a jet propulsion boat hull having a tunnel as the rear end thereof, a jet propulsion unit contained with said tunnel, said trim adjusting device being comprised of a trim adjusting plate adapted to underlie said jet propulsion unit and close said tunnel at least at rear underside edge of said boat hull, threaded fastening means for rigidly affixing said trim adjusting plate to said hull, and angle adjusting means interposed between said hull and said trim adjusting plate for setting the trim angle of said trim adjusting plate relative to said hull.

2. A trim adjusting device as set forth in claim 1 wherein the angle adjusting means has a threaded connection to the trim adjusting plate.

3. A trim adjusting device as set forth in claim 2 wherein the threaded fastening means pass through the angle adjusting means.

4. A trim adjusting device as set forth in claim 3 wherein the threaded fastening means engage the hull and the angle adjusting means abuttingly engages the hull.

5. A trim adjusting device as set forth in claim 4 wherein the angle adjusting means has a hexagonal portion for facilitating threaded adjustment to the trim adjusting plate.

6. A trim adjusting device as set forth in claim 5 further including means for precluding rotation of the angle adjusting means relative to the trim adjusting plate.

7. A trim adjusting device as set forth in claim 6 wherein the means for preventing rotation comprises the threaded fastening means being eccentrically disposed relative to the axis of rotation of the angle adjusting means for precluding rotation of the angle adjusting means when the threaded fastening means is in position.

8. A trim adjusting device as set forth in claim 1 wherein the angle adjusting means comprises a shim member interposed between the hull and the angle adjusting plate.

9. A trim adjusting device for the underside of a jet propulsion boat hull comprised of a trim adjusting plate adapted to underlie the rear underside edge of said boat hull, threaded fastening means for rigidly affixing said trim adjusting plate said hull, angle adjusting means interposed between said hull and said trim adjusting plate for setting the trim angle of said trim adjusting plate relative to said hull, said angle adjusting means having a threaded connection to the trim adjusting plate by means including threaded fastening means passing through said angle adjusting means, said threaded fastening means engaging the hull and said angle adjusting means abuttingly engages the hull, said angle adjusting means having a hexagonal portion for facilitating threaded adjustment to the tim adjusting plate, said means for precluding rotation of said angle adjusting means relative to said trim adjusting plate, comprising said threaded fastening means being eccentrically disposed relative to the axis of rotation of the angle adjusting means for precluding rotation of the angle adjusting means when the threaded fastening means is in position.

10. A trim adjusting device for the underside of a jet propulsion boat hull comprised of a trim adjusting plate adapted to underlie the rear underside edge of said boat hull, threaded fastening means for rigidly affixing said trim adjusting plate to said hull, and adjusting means interposed between said hull and said trim adjusting plate for setting the trim angle of said trim adjusting plate relative to said hull, said angle adjusting means comprising a shim member interposed between the hull and said angle adjusting plate.

* * * * *